US007134978B2

(12) United States Patent
Liu et al.

(10) Patent No.: US 7,134,978 B2
(45) Date of Patent: Nov. 14, 2006

(54) SEAMLESS BB PAINTBALL

(75) Inventors: Suying Liu, Taipei Shien (TW); Ming Cherng Chou, Tao Yuan (TW); Hui Ying Chen, Keelung (TW)

(73) Assignee: Sagittarius Life Science Corporation (TW)

( * ) Notice: Subject to any disclaimer, the term of this patent is extended or adjusted under 35 U.S.C. 154(b) by 0 days.

(21) Appl. No.: 10/629,212

(22) Filed: Jul. 28, 2003

(65) Prior Publication Data

US 2005/0025968 A1 Feb. 3, 2005

(51) Int. Cl.
*A63B 39/00* (2006.01)
*F42B 8/12* (2006.01)

(52) U.S. Cl. ..... 473/577; 473/594; 102/502

(58) Field of Classification Search ..... 473/577, 473/594; 102/502, 513
See application file for complete search history.

(56) References Cited

U.S. PATENT DOCUMENTS 4,656,092 A * 4/1987 Haman et al. ..... 102/502
6,375,981 B1 * 4/2002 Gilleland et al. ..... 424/452
6,530,962 B1 * 3/2003 Stolz ..... 102/502
6,589,536 B1 * 7/2003 Brox et al. ..... 424/400

* cited by examiner

*Primary Examiner*—Steven Wong
(74) *Attorney, Agent, or Firm*—Harness, Dickey & Pierce

(57) ABSTRACT

This invention is utilizing the principle of repulsion between oil and water, the differences of surface tension of oil and water, and the character of melting of gelatin materials in high temperature and solidification in cold temperature to produce a biodegradable seamless BB paintball for BB guns. It contains a colored edible oil solution and is safe when it hits the target to produce an obvious mark that is edible. The seamless paintballs so produced are consistent in size and weight. It reduces the possibility of jamming during shooting and loading of BB guns which are common complaints of the conventional BB paintballs. A specially designed double nozzled machine can produce oil-in-water perfectly round and seamless droplets. The oil solution contains the dyes and the water solution contains a specially formulated gelatin. The droplets are then solidified by a chilled cooling oil flow. The oil solution comprises of 1%–5% (W/W) edible dye in edible oil. The water solution comprises of 10%–34% gelatin that can also consist of 1%–10% polyethylene glycol (PEG), 1%–10% starch and 0.1%–1% edible dye in distilled water.

20 Claims, 6 Drawing Sheets

SEAMLESS BB PAINTBALL

1. FIELD OF THE INVENTION

The present invention consists of the shown type of seamless BB Paintball, which employs new technology to manufacture BB pellets similar to Paintball by environmental friendly materials. These BB pellets can be used for recreational games and military and police field training.

2. BACKGROUND OF THE INVENTION

Pellets currently used for recreational games and military and police training generally fall into the following two categories: BB pellets and Paintball.

Figure 1:
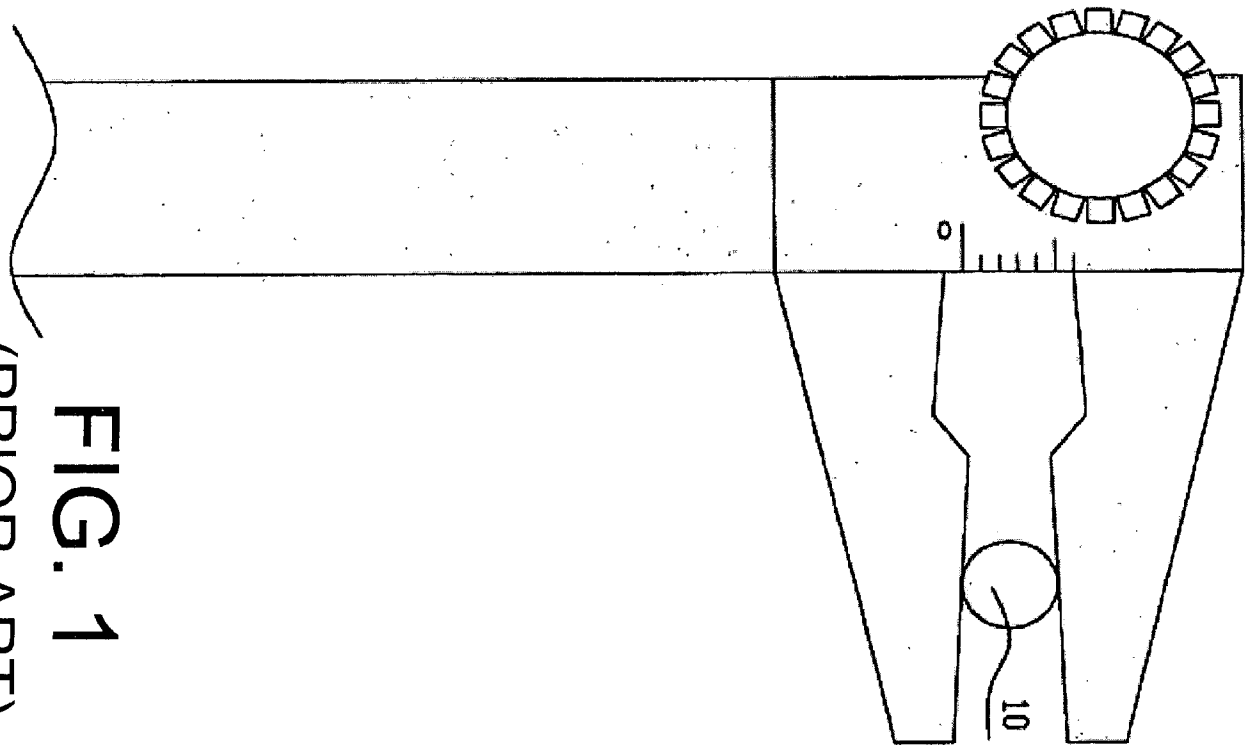
FIG. 1 (PRIOR ART)

BB pellets (10): Approximately 6 mm in diameter and approximately 0.12~0.33 grams in weight. The BB pellet shown in FIG. 1 is comprised of non-environmental friendly plastic ball or a plastic-coated metal ball. Their advantages include low cost, suitability for continuous firing, high accuracy, and widespread compatibility with plastic toy guns and simulation metal regulation pistols, rifles, or machine guns. When shot from a simulation metal gun, the pellets provide a sense of reality similar to the firing of real bullets. On the other hand, the pellets are manufactured by materials that are not decomposed readily, and therefore, they tend to pollute the environment. In addition, when shot at a high speed, hard metal balls may potentially cause injury or death of the players. When used for recreational games and military or police field training, this type of pellet presents the disadvantages of safety, biohazards and difficulty in accurate targeting.

Paintball (20): Approximately 17.5~17.7 mm in diameter and approximately 3.8~3.9 grams in weight. The Paintball shown in FIG. 2 contains an edible solvent and dye, and is manufactured by environmental friendly materials. The Paintball ruptures and releases the colored solution after striking the target, making a colored mark on the target that can be used to objectively assess the results of the game or training. Nevertheless, Paintball have the disadvantages of being excessively large, excessively heavy, compatible only with special guns, and entirely incompatible with simulation guns: Since Paintballs have an extremely soft outer shell, they cannot be loaded into the clip of the gun in a continuous fashion, and consequently cannot be fired continuously. While this is barely accepted in recreational games, it is practically useless as military and police training tools.

3. Description of the Prior Art

U.S. Pat. No. 5,393,054 of 1995 records one type of Paintball consisting of a gelatin-coated distilled aqueous solution. The present invention not only differs from the aforementioned patent in terms of the percentages of gelatin and the enclosed material, but also employs an oil-based solution as the enclosed material. The present invention is thus substantially different from the aforementioned patent.

Figure 3:
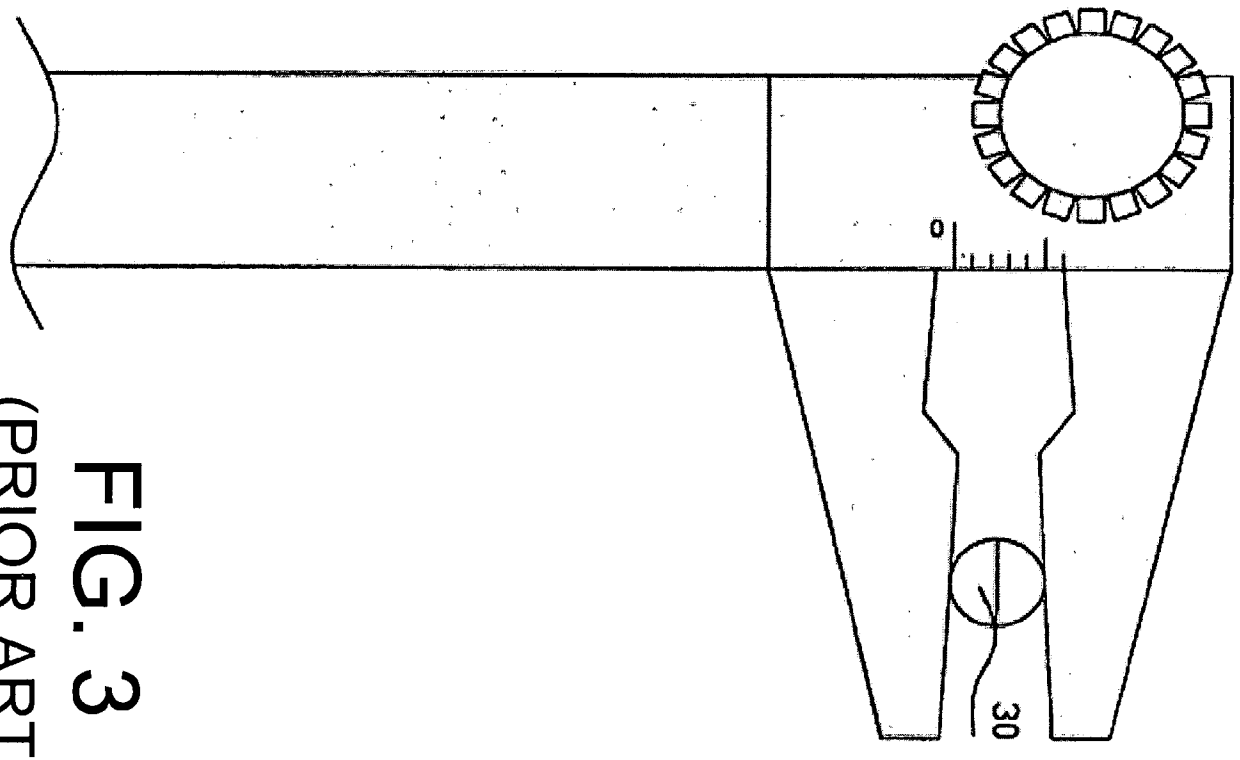
FIG. 3 (PRIOR ART)

With regard to 6 mm BB Paintball (30) sold in Taiwan and in foreign markets, FIG. 3 shows the-use of two hemispherical molds to manufacture two round, seamed, oval gelatin capsules filled with distilled aqueous solution containing a dye. Players who use this type of product perceive certain disadvantages, including the fact that the gelatin capsule is too soft and cannot be fired continuously, and also that the capsule becomes even softer with time and soon cannot be used at all. In addition, the seams on the oval gelatin capsules render roughness in their surfaces, and thus affect firing accuracy. The present invention discloses a type of SEAMLESS BB Paintball manufactured by a proprietary procedure that is clearly different from the market available seamed products.

The present invention employs new technology to manufacture seamless BB Paintball (24) for use in BB guns. This BB Paintball is similar to BB pellet in size, but is manufactured by environmental friendly materials. The advantages of the present invention include environmental safety, continuous firing, high accuracy, and the ability to clearly mark the target. The present invention also provides a sense of reality similar to the firing of real bullets.

4. BRIEF DESCRIPTION OF THE DRAWINGS

Figure 2:
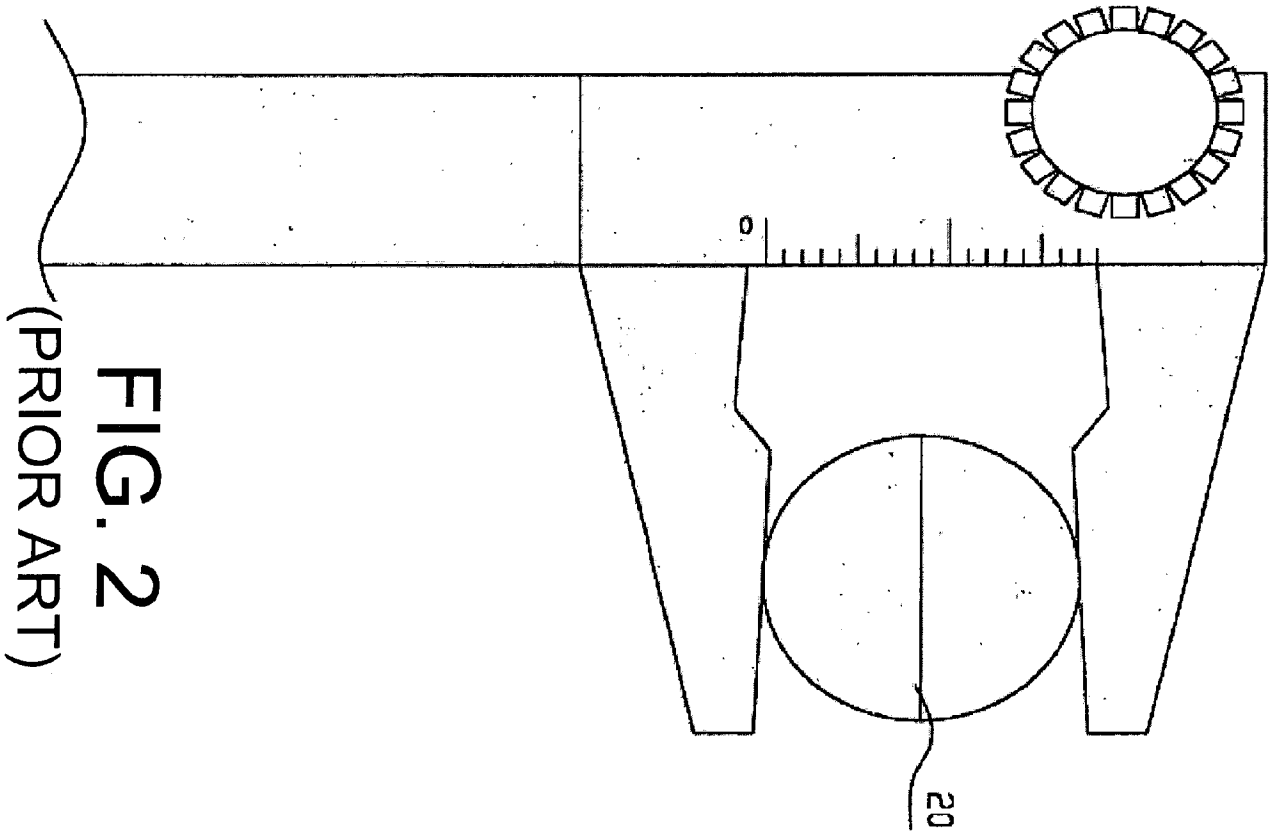
FIG. 2 (PRIOR ART)
Figure 4:
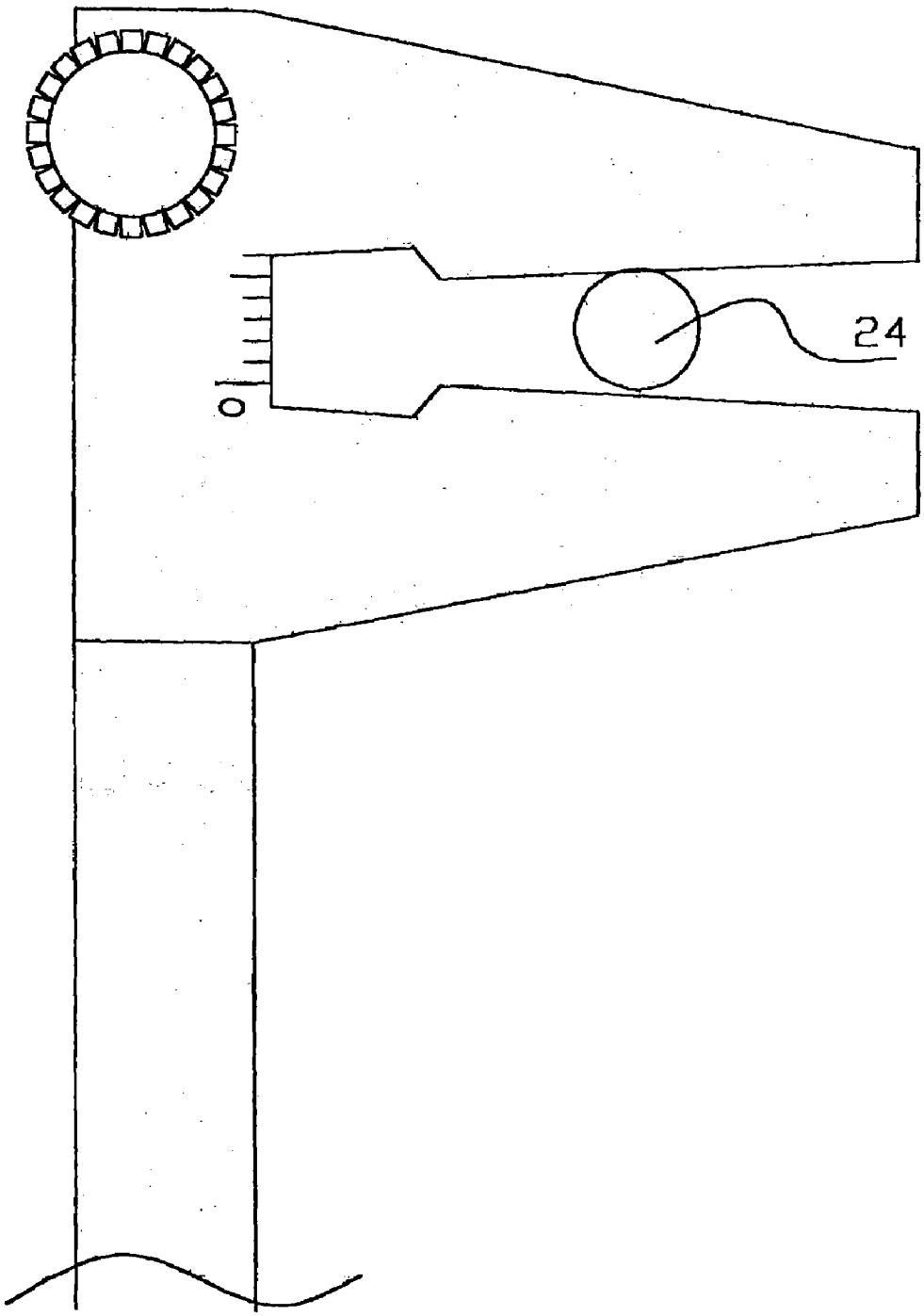
Figure 5:
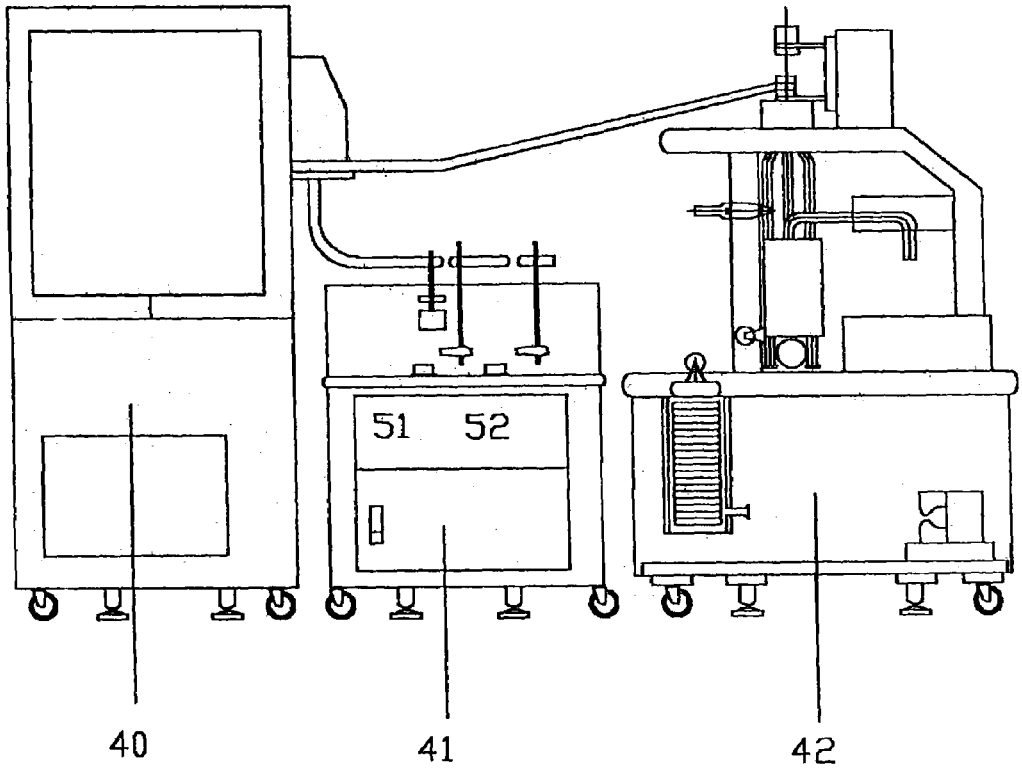
Figure 6:
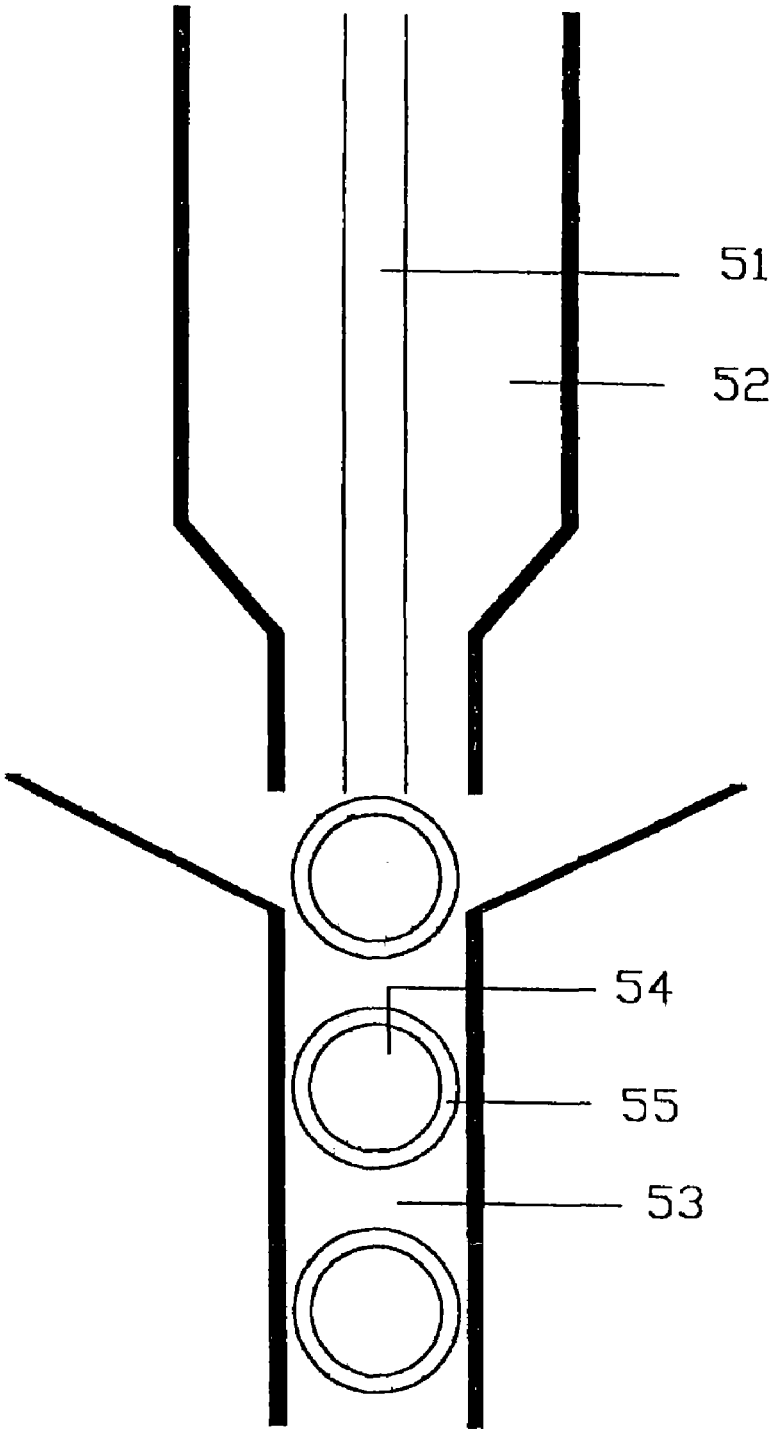

FIG. 1 BB pellet
FIG. 2 Paintball
FIG. 3 BB Paintball sold on the market
FIG. 4 Molding equipment
FIG. 5 Manufacturing of spherical gelatin capsules
FIG. 6 Seamless BB Paintball

5. DETAILED DESCRIPTION OF THE PRESENT INVENTION

The seamless BB Paintball (24) of the present invention employs a type of edible soft gelatin capsule as an outer shell. Enclosed in the shell is edible oil and dye. These materials are food grade, non-corrosive, biodegradable, and non-polluting. They are harmlessly excreted by the human digestive tract if accidentally swallowed.

The seamless BB Paintballs are manufactured by using an appropriate molding equipment based on the nature of mutual insolubility of distilled water and oil, the differential surface tension between the two solutions, and the property of gelatin that is melted at higher temperature and solidified at lower temperature. The molding equipment shown in FIG. 4 consists of three major parts: A control panel (40) located at the left-hand side that provides power and controls of production conditions; a raw material storage tank (41) located in the center; and a molding apparatus (42) located on the right-hand side. FIG. 5 shows two concentric nozzles, of which the inner nozzle sprays oil-based solution and the outer nozzle simultaneously sprays distilled aqueous solution. After the fluid of outer layer has completely coated the fluid of inner core instantly, and coated drops thereupon drips into the cooling oil, solidify and form ball-shaped gelatin capsules with smooth, seamless surfaces. As shown in FIG. 6, this is the finished seamless BB Paintball (24) product of the present invention.

The present invention employs food-grade soft gelatin capsules enclosing edible dye and oil. The oil can be either an edible synthetic oil or vegetable oil; it can be selected from peanut oil, soybean oil, corn oil, sunflower oil, olive oil, short-chain or medium-chain fatty acid. A "short-chain" fatty acid refers to a fatty acid with carbon chains consisting of eight fatty acids, while a "medium-chain" fatty acid refers to a fatty acid with carbon chain consisting of 16 fatty acids. Both short-chain and medium-chain fatty acid can be selected from saturated or unsaturated edible fatty acids. PEG (polyethylene glycol) or starch can be added when necessary to adjust the viscosity of the oil. PEG added can be a mixture selected from, two, or more than two types of PEGs. PEG of an average molecular weight between 200 and 6000 daltons is typically added. Edible starch, such as corn starch, potato starch, is also commonly added.

The oil-based solution is composed of edible synthetic oil or vegetable oil containing 1%–5% edible dye (W/W). The aqueous solution is composed of distilled water containing 10%–34% gelatin (W/W) that can also contain 1%–10% PEG, 1%–10% starch, and 0.1%–1% edible dye (W/w). Preferentially, the aqueous solution in this invention is consisted of 15%–30% gelatin, 1%–5% PEG, 6%–10% starch, and 0.6%–1% edible dye (W/W).

The manufacturing procedures required to produce BB Paintball of this invention consist of the sequential steps of preparation of materials, molding and solidifying, degreasing, drying, and completion of finished product.

These steps are described as follows:

1. Preparation of Materials:

(1) The oil-based solution is composed of 1%–5% edible dye in edible synthetic oil or vegetable oil. The two components must be mixed to homogeneous consistency after weighing out the correct amounts of each component. This produces a colored oil-based solution. The edible dye can be changed to any color as desired. The oil can be an edible synthetic oil with either short- or medium-chain fatty acids, peanut oil, soybean oil, corn oil, sunflower oil, olive oil, vegetable oil, etc.

(2) The aqueous solution contains 10%–34% gelatin, 1%–10% PEG, 1%–10% starch, and 0.1%–1% edible dye in distilled water. After weighing out the correct amounts of each of the above materials, the dye and distilled water are mixed to homogeneous consistency. PEG, starch, and gelatin are then sequentially added and mixed. The preparation of aqueous solution is completed after heating at 70° C. to dissolve the mixture and removal of air bubbles. The colors of edible dye can be changed to any color as necessary to meet different needs. The PEG can consist of two or more types with different molecular weights, and have an average molecular weight between 200 and 6000 daltons.

2. Molding and Solidifying:

Molding and solidifying procedures are performed by the machine shown in FIG. 4. This machine consists of three major parts: A control panel (40) is located at the left-hand side that provides power and controls production conditions; A raw material storage tank (41) is located in the center; A molding apparatus (42) is located on the right-hand side.

Following the preparation of materials, the oil-based solution and aqueous solution are poured into a tank kept at room temperature (51) and a tank kept at 70° C., respectively (52). Pumps on the control panel simultaneously pump the oil-based solution and aqueous solution via respective pipes to the molding apparatus on the right-hand side of the machine. The molding apparatus contains two round concentric nozzles. The inner nozzle with a diameter of 1.0~4.3 mm sprays the oil-based solution and the outer nozzle with a diameter of 5.8~8.6 mm simultaneously sprays aqueous solution kept at a temperature of 70° C. This process forms a spherical gelatin capsules filled with oil-based dye solution via surface tension created by mutually incompatible interfaces. The gelatin capsules are solidified in cooling oil (53) with a temperature of 4~10° C. and a flow rate of 0.06~0.25 ml /sec. The formed gelatin capsules have a diameter in the range of 6~10 mm.

3. Degreasing: A centrifuge is used to remove oil and grease from the surface of the gelatin capsules.

4. Drying: Drying equipment is used to dry and harden the gelatin capsules. The gelatin capsules after the drying procedure have an average diameter of 5~9 mm.

Any person familiar with the aforementioned technical processes who reads the detailed descriptions of optimal embodiments in the following diagrams will certainly gain a clear understanding of the goals and advantages claimed for the present invention.

Embodiment 1

| Content | W/W |
|---|---|
| Oil-based solution | |
| Peanut oil | 95% |
| Edible dye | 5% |
| Aqueous solution | |
| Gelatin | 34% |
| PEG | 2% |
| Starch | 3% |
| Edible dye | 0.1% |
| Distilled water | 60.9% |

Embodiment 2

| Content | W/W |
|---|---|
| Oil-based solution | |
| Soybean oil | 98% |
| Edible dye | 2% |
| Aqueous solution | |
| Gelatin | 16% |
| PEG | 1% |
| Starch | 10% |
| Edible dye | 0.8% |
| Distilled water | 72.2% |

Embodiment 3

| Content | W/W |
|---|---|
| Oil-based solution | |
| Short-chain fatty acid | 99% |
| Edible dye | 1% |
| Aqueous solution | |
| Gelatin | 10% |
| PEG | 10% |
| Starch | 8% |
| Edible dye | 0.3% |
| Distilled water | 71.7% |

Embodiment 4

| Content | W/W |
|---|---|
| Oil-based solution | |
| Corn oil | 96% |
| Edible dye | 4% |
| Aqueous solution | |
| Gelatin | 22% |
| PEG | 5% |
| Starch | 1% |
| Edible dye | 0.5% |
| Distilled water | 71.5% |

Embodiment 5

| Content | W/W |
|---|---|
| Oil-based solution | |
| Sunflower oil | 97% |
| Edible dye | 3% |
| Aqueous solution | |
| Gelatin | 28% |
| PEG | 3% |
| Starch | 6% |
| Edible dye | 1% |
| Distilled water | 62% |

Embodiment 6

| Content | W/W |
|---|---|
| Oil-based solution | |
| Medium-chain fatty acid | 97.5% |
| Edible dye | 2.5% |
| Aqueous solution | |
| Gelatin | 25% |
| PEG | 7% |
| Starch | 5% |
| Edible dye | 0.7% |
| Distilled water | 62.3% |

The seamless BB Paintball of this invention manufactured by a proprietary. procedure employs a type of edible soft gelatin capsule as an outer shell. This seamless shell is filled with edible oil and dye that are non-corrosive, biodegradable, and non-polluting as the core. They are harmlessly excreted by the human digestive tract if accidentally swallowed.

In summary, this invention is original, novel, and represents improvement. Although several optimal embodiments of this invention have been described herein, these examples are not intended to limit the applicability of this invention. Anyone familiar with this technology would be able to make some changes and embellishments without departing from the spirit and scope of the invention. Because of this, the protected scope of this patent should be seen as the applied for patent scope attached to this application.

What is claimed:

1. A seamless BB Paintball comprising:

an oil-based solution including 1%–5% (W/W) edible dye in edible oil selected from a group consisting of vegetable oils and synthetic oils; and a generally spherical gelatin-based shell enclosing the oil-based solution and formed from a gelatin-based aqueous solution including 10%–34% (W/W) gelatin,

1%–10% (W/W) PEG,

1%–10% (W/W) starch, and 0.1%–1% (W/W) edible dye.

2. The seamless BB Paintball according to claim 1, wherein:

the generally spherical gelatin shells have a diameter of 5–9 mm after drying and hardening.

3. The seamless BB Paintball according to claim 1, wherein:

the vegetable oils are selected from a group consisting of peanut oil, soybean oil, corn oil, sunflower oil and olive oil.

4. The seamless BB Paintball according to claim 1, wherein:

the vegetable oils are selected from a group consisting of short-chain and medium-chain fatty acids.

5. The seamless BB Paintball according to claim 1, wherein:

the PEG is selected from PEGs having molecular weight between 200 and 6000 daltons.

6. The seamless BB Paintball according to claim 1, wherein:

the PEG includes at least two different types of PEG having different molecular weights.

7. The seamless BB Paintball according to claim 5, wherein:

the PEG has an average molecular weight between 400 and 6000 daltons.

8. The seamless BB Paintball according to claim 1, wherein:

the PEG includes only one type of PEG.

9. A seamless BB Paintball comprising:

an oil-based solution including 1%–5% (W/W) edible dye in an edible oil selected from a group consisting of vegetable oils and synthetic oils; and a generally spherical gelatin-based shell enclosing the oil-based solution and formed from a gelatin-based aqueous solution including 15%–30% (W/W) gelatin,

1%–5% (W/W) PEG,

6%–10% (W/W) starch, and 0.6%–1% (W/W) edible dye.

10. A seamless BB Paintball comprising:

an oil-based solution including 1%–5% (W/W) edible dye in an edible oil selected from a group consisting of vegetable oils and synthetic oils; and generally spherical gelatin-based shell enclosing the oil-based solution and formed from a gelatin-based aqueous solution including 10%–34% (W/W) gelatin,

1%–10% (W/W) PEG,

1%–10% (W/W) starch, and 0.1%–1% (W/W) edible dye, wherein a dry weight ratio of the gelatin and PEG incorporated in the shell is between 17.0 and 1.0.

11. A seamless BB Paintball according to claim 10, wherein:

the dry weight ratio of the gelatin and PEG incorporated in the shell is between 9.3 and 4.4.

12. A seamless BB Paintball according to claim 10, wherein:

the dry weight ratio of the gelatin and PEG incorporated in the shell is between 9.3 and 1.0.

13. A seamless BB Paintball according to claim 10, wherein:

the dry weight ratio of the gelatin and PEG incorporated in the shell is between 4.4 and 1.0.

14. A seamless BB Paintball comprising:

an oil-based solution including 1%–5% (W/W) edible dye in an edible oil selected from a group consisting of vegetable oils and synthetic oils; and a generally spherical gelatin-based shell enclosing the oil-based solution and formed from a gelatin-based aqueous solution including 15%–30% (W/W) gelatin,

1%–5% (W/W) PEG,

6%–10% (W/W) starch, and 0.6%–1% (W/W) edible dye, wherein the shell is of a unitary, one-piece construction.

15. A seamless BB Paintball according to claim 14, wherein:

the dry weight ratio of the gelatin and PEG incorporated in the shell is between 9.3 and 4.4.

16. A seamless BB Paintball according to claim 14, wherein:

the dry weight ratio of the gelatin and PEG incorporated in the shell is between 17.0 and 1.0.

17. A seamless BB Paintball according to claim 14, wherein:

the dry weight ratio of the gelatin and PEG incorporated in the shell is between 4.4 and 1.0.

18. The seamless BB Paintball according to claim 14, wherein:

the PEG is selected from PEGs having molecular weight between 200 and 6000 daltons.

19. The seamless BB Paintball according to claim 14, wherein:

the PEG includes a first PEG having a first molecular weight $MW_1$ and a second PEG having a second molecular weight $MW_2$, wherein the expression $MW_1 \neq MW_2$ is satisfied.

20. The seamless BB Paintball according to claim 14, wherein:

the PEG has an average molecular weight between 400 and 6000 daltons.

* * * * *